US011180956B2

(12) United States Patent
Gaines

(10) Patent No.: US 11,180,956 B2
(45) Date of Patent: Nov. 23, 2021

(54) LADDER DOCKING DEVICE

(76) Inventor: Robert G Gaines, Brighton, MI (US)

( * ) Notice: Subject to any disclaimer, the term of this patent is extended or adjusted under 35 U.S.C. 154(b) by 0 days.

(21) Appl. No.: 12/161,127

(22) PCT Filed: Feb. 6, 2007

(86) PCT No.: PCT/US2007/061715

§ 371 (c)(1),
(2), (4) Date: Jul. 16, 2008

(87) PCT Pub. No.: WO2007/092862

PCT Pub. Date: Aug. 16, 2007

(65) Prior Publication Data

US 2009/0000868 A1 Jan. 1, 2009

Related U.S. Application Data

(63) Continuation-in-part of application No. 10/903,690, filed on Jul. 30, 2004, now abandoned.

(60) Provisional application No. 60/765,617, filed on Feb. 6, 2006, provisional application No. 60/491,178, filed on Jul. 30, 2003.

(51) Int. Cl.

| | |
|---|---|
| ***E06C 7/48*** | (2006.01) |
| ***E06C 1/34*** | (2006.01) |
| ***E06C 7/18*** | (2006.01) |

(52) U.S. Cl.

CPC ..... *E06C 7/48* (2013.01); *E06C 1/34* (2013.01); *E06C 7/182* (2013.01); *E06C 7/482* (2013.01)

(58) Field of Classification Search

CPC . E06C 7/48; E06C 7/182; E06C 7/482; E06C 1/34

USPC ..... 182/107, 214, 106

See application file for complete search history.

(56) References Cited

U.S. PATENT DOCUMENTS 415,661 A * 11/1889 White ..... E06C 7/48 182/206
1,018,877 A * 2/1912 Chickering ..... E06C 1/36 182/206
2,448,716 A * 9/1948 Hurd ..... E06C 1/345 182/206

(Continued)

FOREIGN PATENT DOCUMENTS

CA 2322717 A1 * 4/2002 ..... E06C 1/34
CA 2322717 A1 * 4/2002 ..... E06C 7/48

(Continued)

OTHER PUBLICATIONS

Bosch Security Systems FCP-500 Conventional Flush-Mount Smoke Detectors (Located on Bosch Security systems website; URL: http://www.boschsecurity.US/index.aspx?prdctid=3473).

*Primary Examiner* — Daniel P Cahn
*Assistant Examiner* — Candace L Bradford

(57) ABSTRACT

A ladder docking device including a ladder securement device and a pair of handrails is provided. The ladder securement device secures a ladder in an assigned location so that using the ladder while carrying tools and equipment up the ladder becomes safer and more secure. Specifically, the ladder securement device captures one of the ladder rungs to help avoid the ladder bottom from slipping on unstable or slippery surfaces and from sliding off sideways. Handrails of the ladder docking device provide a safe transition when stepping off the ladder or stepping down from the roof.

11 Claims, 5 Drawing Sheets

(56) References Cited

U.S. PATENT DOCUMENTS 4,185,421 A * 1/1980 Robinson ..... E04D 15/00 182/214
4,643,275 A * 2/1987 LeBlanc ..... E06C 7/48 182/107
4,664,224 A * 5/1987 Chen ..... E06C 1/56 182/106
4,678,061 A * 7/1987 Jordan ..... E06C 1/345 182/107
4,765,439 A * 8/1988 Kresmery ..... E06C 7/48 182/107
4,880,200 A * 11/1989 Champagne ..... E06C 1/36 248/547
5,279,389 A * 1/1994 Crockett ..... E06C 7/48 182/129
5,282,339 A * 2/1994 Devlin ..... E02D 29/12 182/106
5,333,323 A * 8/1994 Aymes ..... E04H 4/144 182/93
5,664,643 A * 9/1997 Taylor, Jr. ..... E06C 7/48 182/107
5,743,356 A * 4/1998 Mitchell ..... E06C 7/48 182/107
5,810,304 A * 9/1998 Lehrman ..... D06F 81/00 248/215
6,003,633 A * 12/1999 Rolson ..... E06C 5/02 182/106
6,029,774 A * 2/2000 Cothern ..... E06C 7/188 182/107
6,095,283 A * 8/2000 Ellis ..... E06C 1/38 182/106
6,158,549 A * 12/2000 Hartman, Jr. ..... E06C 1/36 182/206
6,347,685 B1 2/2002 Ellis
6,394,229 B1 * 5/2002 Hastreiter ..... E06C 1/12 182/107
D459,483 S * 6/2002 Roy ..... D25/68
6,427,803 B1 * 8/2002 Moore ..... E06C 7/48 182/107
6,533,069 B1 * 3/2003 Couillard ..... E06C 1/34 182/107
6,578,665 B1 * 6/2003 DeBaca ..... E06C 1/34 182/107
6,691,829 B1 * 2/2004 Stelmach ..... E06C 1/34 182/107
6,739,349 B2 * 5/2004 Kastenschmidt ..... A01J 9/00 137/15.16
7,066,299 B1 * 6/2006 Fleming ..... E06C 1/20 182/107
D757,302 S * 5/2016 Copp ..... D25/68
2005/0045421 A1 * 3/2005 Gaines ..... 182/107
2007/0175699 A1 * 8/2007 Steblinski ..... E02D 17/086 182/82
2011/0232201 A1 * 9/2011 Cardwell ..... E02D 29/127 52/20
2011/0247895 A1 * 10/2011 Smith ..... E06C 7/182 182/106
2012/0160607 A1 * 6/2012 Davis, Jr. ..... E06C 7/188 182/107
2015/0204140 A1 * 7/2015 Umlor ..... E06C 1/04 182/165
2016/0215563 A1 * 7/2016 Ellis ..... E06C 7/48

FOREIGN PATENT DOCUMENTS

CA 2476334 A1 * 1/2005 ..... E06C 1/36
CA 2476334 A1 * 1/2005 ..... E06C 7/482
CA 2868564 A1 * 4/2016 ..... E06C 1/36
CA 2868564 A1 * 4/2016 ..... E06C 7/48

* cited by examiner

LADDER DOCKING DEVICE

CROSS REFERENCES TO RELATED APPLICATIONS

This is a continuation-in-part application of application Ser. No. 10/903,690, filed on Jul. 30, 2004 now abandoned. In addition, this application claims the benefit of U.S. Provisional Application No. 60/765,617 filed on Feb. 6, 2006 which is incorporated herein in its entirety, and this application claims the benefit of U.S. Provisional Application No. 60/491,178 filed on Jul. 30, 2003.

BACKGROUND OF THE INVENTION

1. Field of the Invention

The present invention relates to attachments to buildings. More particularly, the invention relates to a ladder docking device for attaching to a building.

2. Description of the Prior Art

As long as ladders have been used against buildings, they have caused problems with falling over or tipping to one side. In addition, accidents have occurred when the base slips away from a building. In the large commercial buildings that are constantly in need of maintenance, there is always a need for a maintenance man to rest a ladder on the side of the building in order to get up onto the roof. In order to have access to heating, ventilation and air conditioning units these maintenance crews need to be on the roof. Putting ladders up onto commercial buildings, which may be as tall as two or three stories high, is a very dangerous operation. On taller buildings, there are safety code requirements for permanently attached ladders to prevent the falling over of the maintenance men when they are standing on their ladders. However, for buildings that are one, two or even three stories tall, maintenance men are left to their own devices for safety.

The inventor realized this problem, and its respective safety issues. He saw the advantages of putting a ladder securement device at the top of a building as described in US patent publication No. 20050045421. However, the ladder securement device may provide additional stability after a ladder user gets off at the top of the ladder and before he or she steps onto the roof. The previous ladder securement device did not provide the later envisioned hand holds or grips to assist the ladder user climbing up or down at the top of the ladder. As a result, ladder users who must climb down the ladder sometimes experienced difficulties getting down on their hands and knees in order to begin a descent down the ladder. Even so, the initial steps down into the ladder may be difficult to make, as the descending ladder user sometimes cannot gain a secure hand grip on the ladder while taking the first few steps from the top of the ladder down.

As described above, the present practice of descending or ascending the ladder of a building is therefore somewhat unsafe. If a worker's foot slips on a ladder rung either at the beginning of the descent or ascent from the ladder, the worker can easily fall down to the ground or to a lower platform. Thus, it results in serious injury or death in many cases each year. There has heretofore been no steady and accessible handgrip which can be utilized to prevent such a fall.

Therefore, it is an aspect of the present invention to provide a ladder docking device, which is preferably permanently attached to the building. The ladder docking device may include safety posts or rails. Protection from falling is mandatory through OSHA regulations on fixed ladders over 20 feet tall in general industry and 24 feet tall in construction. Protection could be upgraded by having ladder docking devices installed as extra protection. About half of the ladders in use are less than 20 feet high, so such improvements would serve the purpose well if no fall protection exists for these ladders. In addition, there may be a lifting system attached to the ladder docking device to lift heavy tools.

It would be of a great advantage to the maintenance industry if there was provided a ladder docking device to improve the safety of using a ladder leaned up against a building.

SUMMARY OF THE INVENTION

In accordance with the above-noted advantages and desires of the industry, the present invention provides a ladder docking device for attaching to a building. This ladder docking device of the present invention includes a ladder securement device and a pair of handrails. The present invention overcomes the aforementioned problems with the prior art because it enhances the safety of the ladder climbers. More specifically, this invention helps avoid slips and falls at the beginning of descent or the end of ascent from the top of a ladder, and makes ladder climbing much safer and easier.

One specific preferred embodiment has certain features including a ladder securement device having a roof edge cap and a pair of ladder rung catchers fastened on the roof edge cap, with a pair of handrails mounted at each side of the ladder securement device. The ladder rung catchers are spaced apart at a distance to allow a rung of a ladder to be disposed thereon. The handrails enhance the safety of a climber to grab and hold during passage up and down from the top of the ladder.

Another preferred embodiment has features including a ladder securement device having a roof edge cap and a pair of ladder rung catchers fastened on the roof edge cap, with a pair of flared handrails mounted at each side of the ladder securement. In this embodiment, each of the handrails includes a flared section and the flared sections form an opening wide enough to allow (adder climbers with tool belts to walk through without interference with the handrails. Therefore, the flared handrails not only enhance the safety of a climber during passage up and down from the top of the ladder, but also allow the climbers wearing tool belts and carrying certain large tools to easily pass through.

Further another preferred embodiment has features including a ladder securement device having a roof edge cap and a pair of ladder rung catchers fastened on the roof edge cap, a pair of handrails mounted at each side of the ladder securement, and a crossbar interconnecting the pair of the handrails at a location below the ladder securement device. The crossbar reinforces the structure and enhances strength. In addition, this embodiment further includes a plurality of mounting brackets that may be attached to the suitable location of the handrails, so that the ladder docking device may be mounted to the building easily.

There are many advantages of the present invention of the ladder docking device. One of the advantages is that the ladder docking may be permanently attached on the roof, which increases ladder safety, thereby reducing injuries and fatalities. The ladder docking device pitches and secures a ladder in an assigned location so that using the ladder while carrying tools and equipment up the ladder becomes safer, and more secured. Ladder rung catchers of the ladder docking device capture the ladder rung to help avoid the ladder bottom from slipping on unstable or slippery surfaces, such as ice. Handrails provide a safe transition to the roof when stepping off the ladder or stepping down from the roof. Mounting brackets make the ladder docking device easy to be mounted to any buildings without roof penetration. Optionally, the docking device may include end plates to help avoid the ladder from sliding sideways off due to wind or slippage.

Moreover, the ladder docking device is environmentally friendly. For example, it helps avoid building finishes and ground parked vehicles from damage caused by a falling ladder. The ladder docking device does not require a ladder to be docked permanently, so it eliminates a vandal's attraction to permanently-mounted ladders and preserves its beauty and water tight integrity. With the ladder docking device, there would be no more dragging equipment or dirty filters through the inside of the building to use a roof hatch. The ladder docking device also keeps gutters from being banged up by extension ladders.

This technique of the present invention of the ladder docking device may therefore be extended to include not only the docking of ladders, but also docking of other conventional means.

The invention is particularly useful for applications in building construction, marine usage, or any other suitable implementation.

Although the invention will be described by way of examples hereinbelow for specific embodiments having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different embodiments and its details are capable of modifications of various aspects which will be obvious to those of ordinary skill in the art all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE INVENTION

Figure 1:
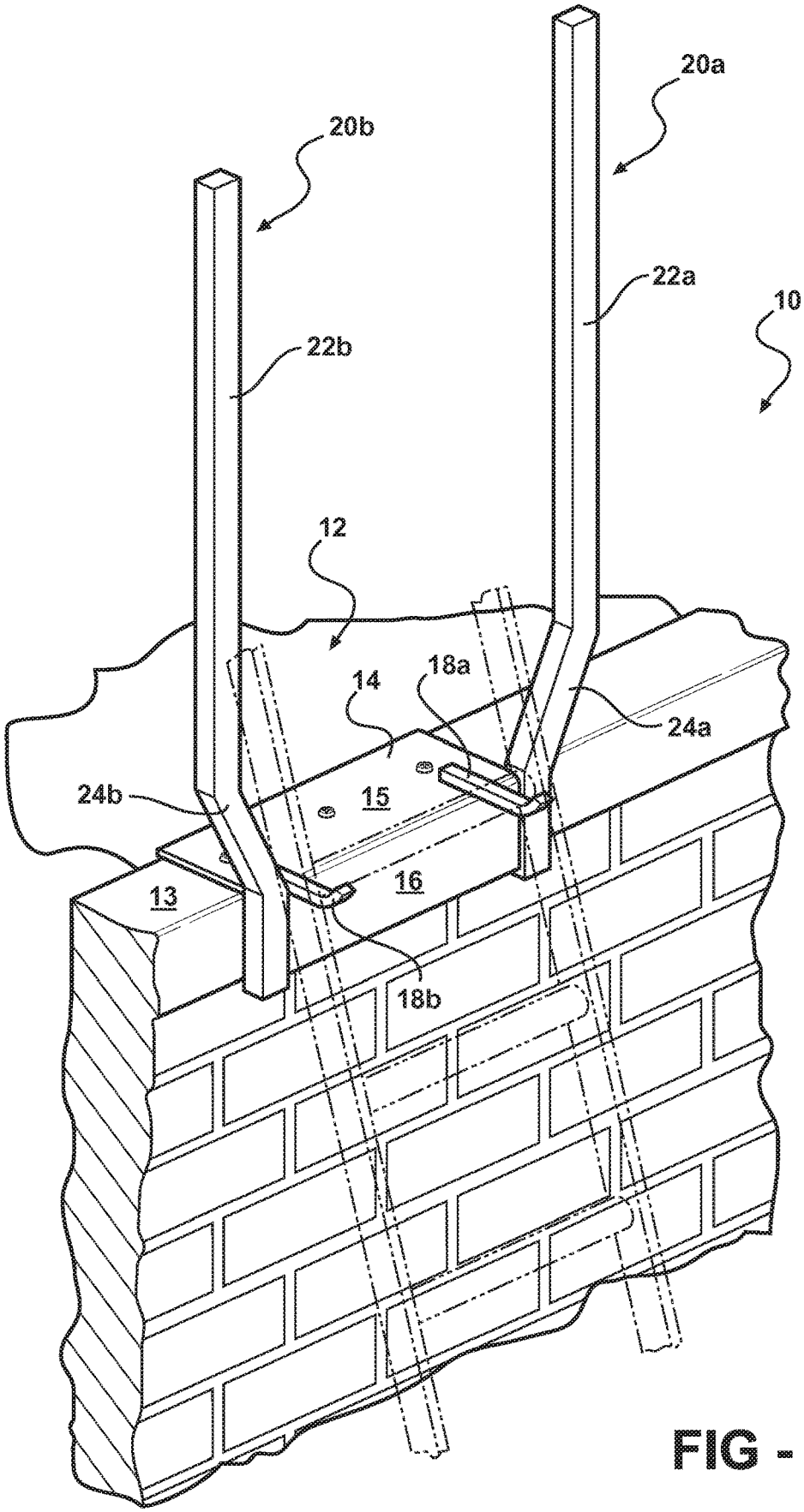
FIG. 1 is a perspective view of a first embodiment of a ladder docking device for a flat roof application made in accordance with the present invention.

While the present invention may comprise embodiments which may take various forms, there is shown in the drawings and will hereinafter be described presently preferred embodiments with the understanding that the present disclosure is to be considered an exemplification of the invention and is not intended to limit the invention to the specific embodiment, size or shape illustrated.

It should be further understood that the title of this section of this specification, namely, "Detailed Description Of The Invention", relates to a requirement of the United States Patent and Trademark Office, and does not imply, nor should be inferred to limit the subject matter disclosed herein.

The ladder docking device of the present invention provides many advantages, such as increasing ladder safety, and reducing injuries and fatalities. Specifically, the ladder docking device pitches and secures a ladder in an assigned location so that using the ladder while carrying tools and equipment up the ladder becomes safer and more secured. This ladder docking device captures the ladder rung to help avoid the ladder bottom from slipping on unstable or slippery surfaces, such as ice, and from sliding sideways off due to wind or slippage. The ladder docking device provides not only a safe transition to the roof when stepping off the ladder or stepping down from the roof, but also a sturdy mount to any building without roof penetration.

As shown in FIG. 1, the present invention discloses a ladder docking device, generally denoted by the numeral 10. Ladder docking device 10 may include a ladder securement device, generally denoted by the numeral 12, to be received over the top edge of a building such as over a building parapet 13. Generally, building parapets are of conventional sizes and shapes, so a modest number of sizes of the ladder securement device can be made to accommodate the various building parapet dimensions. In the alternative, an adjustable ladder securement device is also contemplated, possibly including telescoping parts or arms. Ladder securement device 12 includes a roof cap 14 having roof faceplates 15 and wall faceplate 16, which form a right angle for purposes of making contact with a flat roof and exterior wall of a building. Roof edge cap 14 is secured to the top of building parapet 13 by fasteners. These fasteners may include any suitable conventional fasteners. Any conventional fasteners for securing, fastening or joining known to those skilled in the art may be used, which includes screws, glue, bolts, clamps, clips, rivets, hooks, clasps, latches, nuts, pins, pegs, slots, and slits, among others.

Ladder rung hooks 18*a* and 18*b* may be disposed on roof faceplate 15 at a suitable distance to provide a catch for a rung on the ladder (shown in phantom). Although two ladder rung hooks 18*a* and 18*b* are shown in the present embodiment, it is envisioned by the inventor that more or less ladder rung hooks may be utilized. In practice, a climber would raise his ladder up to the edge of the building and hook one of the top rungs of his ladder onto ladder rung hooks 18*a* and 18*b*, which would help to hold the ladder in place. As the ladder docking device 10 will be firmly and securely attached to the building by fasteners, the ladder should be relatively secure.

Ladder docking device 10 also includes a pair of handrails, generally denoted by numeral 20*a* and 20*b*. Handrails 20*a* and 20*b* are preferably parallel, vertical, and spaced apart at a distance from about 24 to 40 inches. Preferably, handrails 20*a* and 20*b* may be mounted at the edge of the ladder securement device 12, extending vertically to form hand holds or grips. Each of the handrails, 20*a* and 20*b* as an example, may further include vertical sections 22*a* and 22*b* with flared sections 24*a* and 24*b* at the bottom through which the climber walks after climbing up to the ladder. The flared sections 24*a* and 24*b* of handrails 20*a* and 20*b* preferably form an opening which is wide enough for the climber to walk through without interference with any tool belts that might be worn by the climber. According to U.S. Army Mil-Std, 1472C (1980), the width of a climber's hips especially ranges from 11.1 to 16.4 inches across the front and a climber's buttocks range from 7.6 to 14.0 inches from front to back. Tools on the climber's body can add to these dimensions, so the flared sections 24*a* and 24*b* of handrails 20*a* and 20*b* help to minimize the climber's contact with the handrails 20*a* and 20*b*. Handrails 20*a* and 20*b* are easy for the climber to grab and hold during passage up into and down from the top of the ladder. If a foot of the climber slips during such mounting and dismounting of the ladder, the climber can immediately hold the handrails to regain his balance.

The preferred material of the handrails 20*a* and 20*b* may be galvanized steel, stainless steel, aluminum, fiberglass polymer, wood, or any other sturdy substance when the handrails 20*a* and 20*b* are mounted onto the ladder securement device 12. Improved fastening devices can be used to permit a mechanical attachment without the need to drill holes through the handrails 20*a* and 20*b* to attach metal bolts thereto. The assembly including the ladder securement device 12 with the handrails 20*a* and 20*b* can be bolted together or welded with seamless joints in such a way that the welds will not break under a normal load or through corrosion or by any other reasonably destructive means.

In operation of this preferred embodiment, a crewman would place the top rung of his extension ladder up onto the ladder rung hooks 18*a* and 18*b*, between the handrails 20*a* and 20*b*, and against the edge of the roof cup 14. As the crewman climbs up the ladder, he can hold the handrails 20*a* and 20*b* before getting off the top of the ladder and then approach the building roof more confidently. Consequently, he can carry pieces of equipment up the ladder. The ladder docking device may be permanently mounted to the building, so that it will be there anytime the maintenance crewman needs to put a ladder against the side of the building to get up to the building roof.

Figure 2:
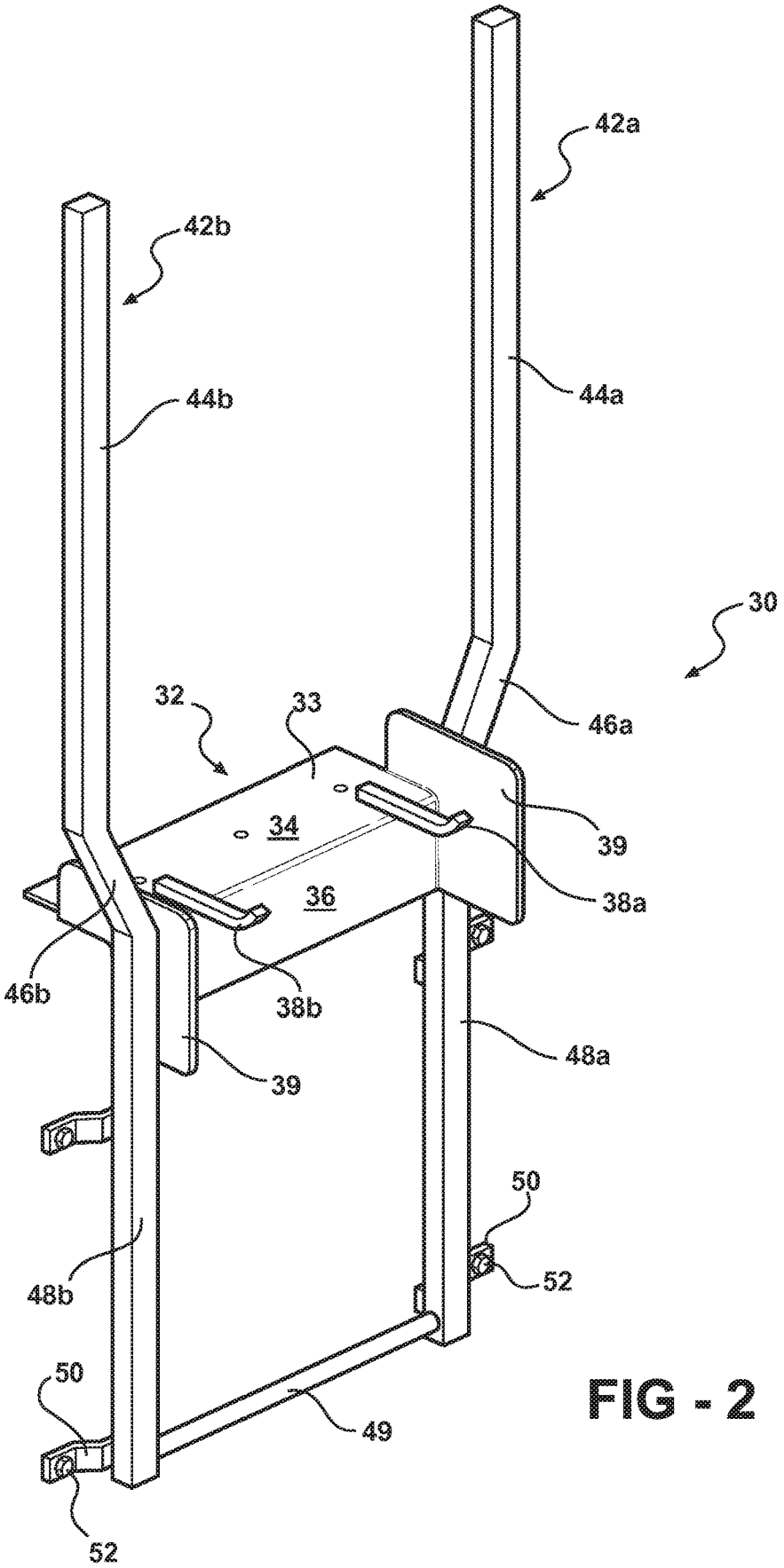
FIG. 2 is a perspective view of a second embodiment of a ladder docking device.

FIG. 2 is a perspective view of a second embodiment of the ladder docking device, generally denoted by the numeral 30. Ladder docking device 30 includes a ladder securement device, generally denoted by the numeral 32, with a roof edge cap 33 having roof faceplates 34 and wall faceplate 36, which form a right angle for purposes of making contact with a flat roof and exterior wall of a building. Two ladder rung hooks 38*a* and 38*b* are disposed on the roof faceplate 34 at a suitable distance to catch a rung on the ladder. End plates 39 may be attached to at both sides of the ladder securement device 32; therefore, the side-to-side motion of a ladder may be deterred by end plates 39. End plates 39 can be either constructed of a solid piece of sheet metal or plastic or any other suitable material, or it may preferably be made of wire or mesh or any other sturdy support material which will help avoid the ladder from sliding from side to side. A pair of handrails 42*a* and 42*b* are attached on the other side of the end plates 39. Handrails 42*a* and 42*b* include a first vertical section 44*a* and 44*b* followed by flared sections 46*a* and 46*b* ending with second vertical sections 48*a* and 48*b*. The distance between the first vertical sections 44*a* and 44*b* are generally wider than the distance between the second vertical sections 48*a* and 48*b* because of the flared sections 46*a* and 46*b*. It is optional to have a crossbar 49 interconnecting handrails 42*a* and 42*b*. Crossbar 49 reinforces the overall structure of the ladder docking device and enhances its loading strength.

This embodiment is suitable to be mounted directly on the walls of a building. A plurality of mounting brackets 50 having fasteners 52 are further provided to be attached to various suitable locations on the second vertical sections 48*a* and 48*b* of the handrails 42*a* and 42*b*, respectively. This embodiment may be fabricated and assembled in one complete piece at the shop. It is also convenient to stack the ladder docking device together for convenient storage or transportation.

Figure 3:
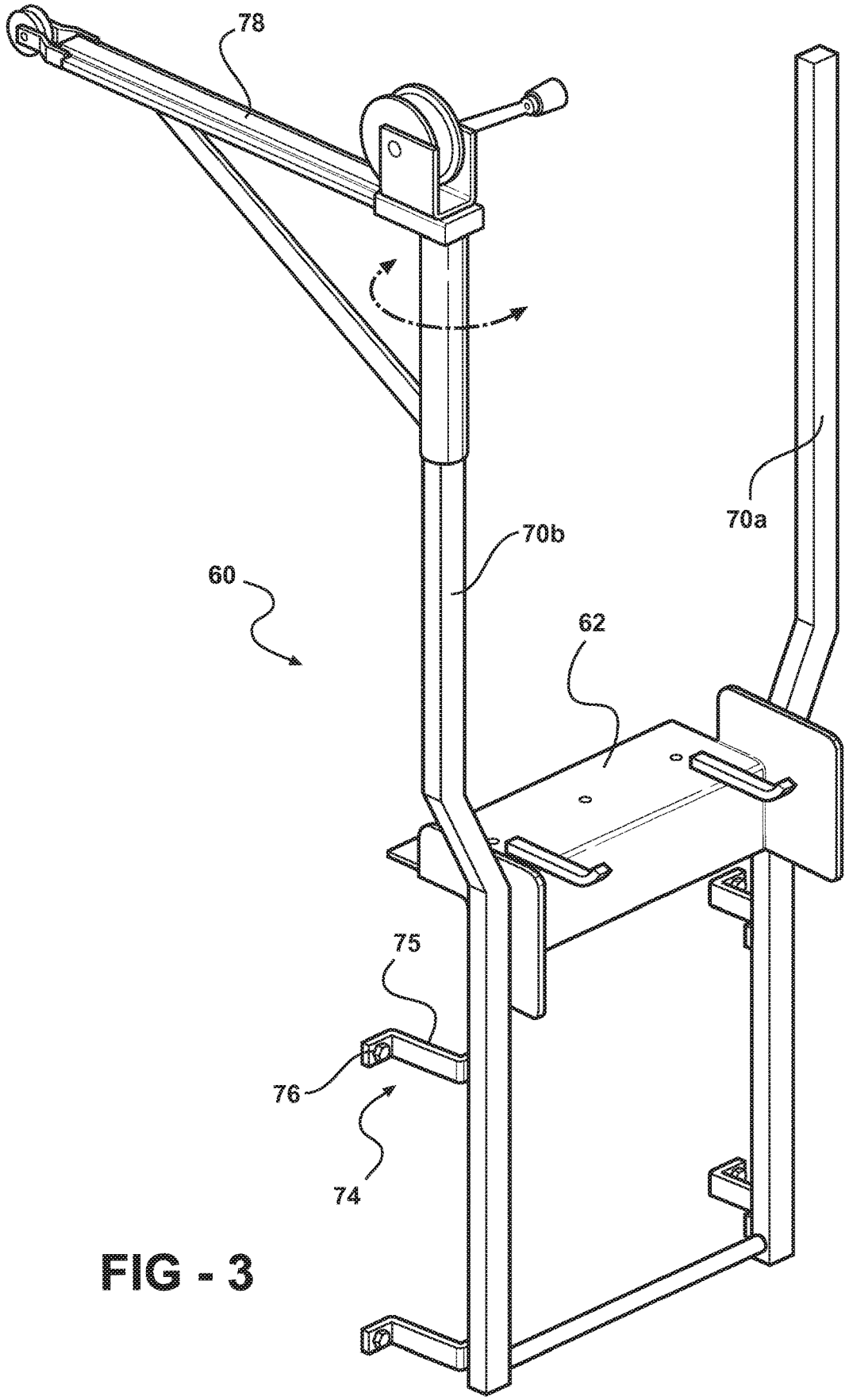
FIG. 3 is a perspective view of a third embodiment of a ladder docking device, including a plurality of support legs and a lifting system.
Figure 4:
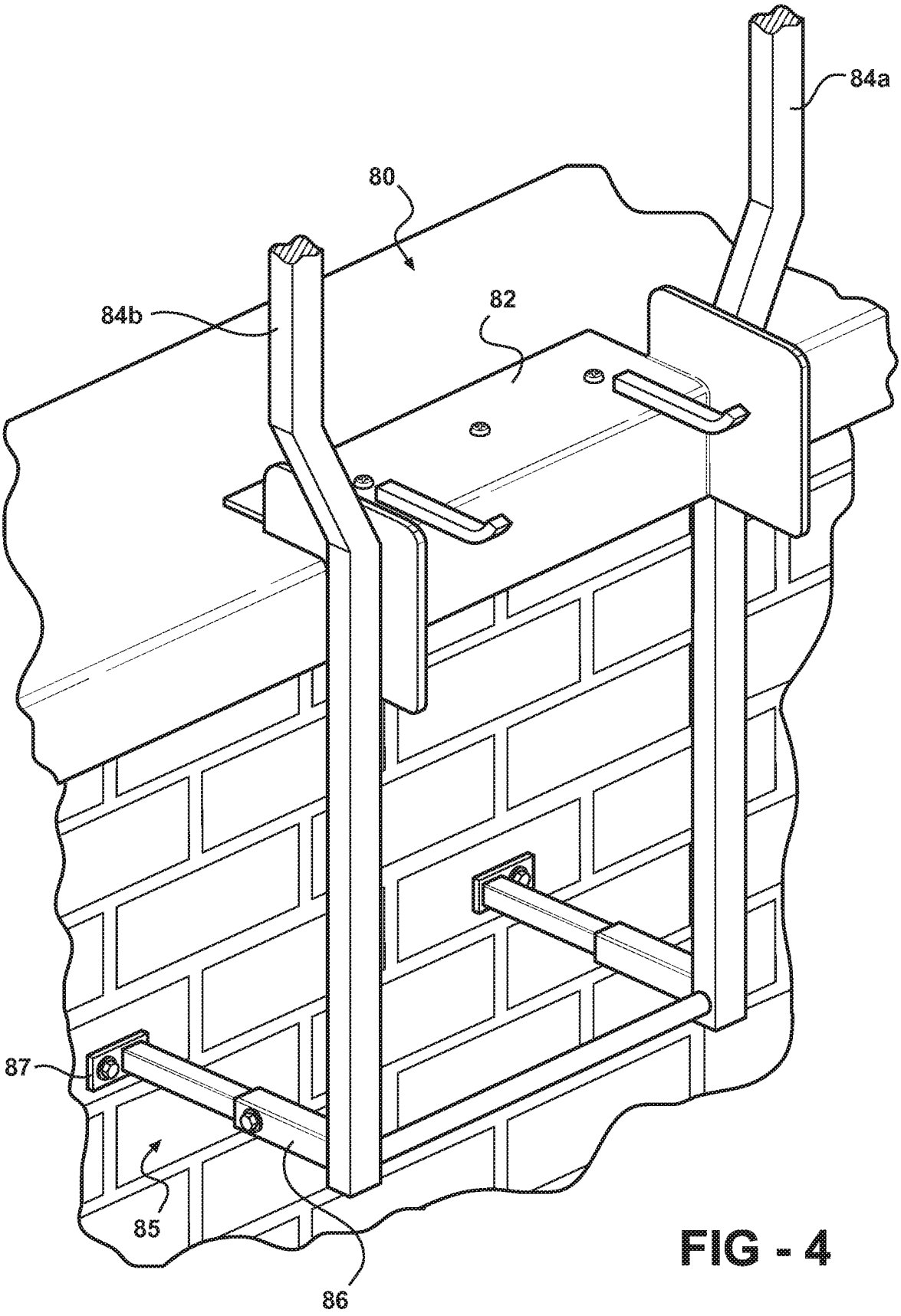
FIG. 4 is a perspective view of a fourth embodiment of a ladder docking device, including a plurality of adjustable support legs.

FIG. 3 is perspective view of a third embodiment of the ladder docking device, generally denoted by numeral 60, including a plurality of mounting brackets 74 and a lifting device 78. In addition to a ladder securement device 62 and a pair of vertical handrails 70*a* and 70*b* as described above, ladder docking device 60 may further include a lifting device 78. Lifting device 78 may preferably be a winch rotatably attached or hinged to one of the handrails 70*a* and 70*b*. Lifting device 78 may be operated manually or electrically and preferably be able to lift loads over 50 lbs. For embodiments with such lifting devices, the material of the handrails may be galvanized steel, stainless steel, aluminum, fiberglass polymer, wood, or any other sturdy material capable of holding the human body and heavy tools which may be over 50 lbs when the handrails are mounted onto the ladder docking device. Each of the plurality of mounting brackets 74 may include a wall mount leg 75 attached to a mounting bracket 76. A wall mount leg may be of a single length if the dimension is known beforehand, or may be utilized as an adjustable feature, as shown in FIG. 4. Ladder docking device 60 will therefore attach to the top of the building via ladder securement device 62 can attach to the side of the building via the plurality of mounting brackets 74. This will allow a gutter to extend underneath the ladder docking device 60 without damaging the gutter.

FIG. 4 shows an adjustable ladder docking device, generally denoted by numeral 80. In addition to a ladder securement device 82 and a pair of vertical handrails 84*a* and 84*b* as described above, ladder docking device 60 further includes at least a pair of adjustable mounting brackets 85. Each adjustable mounting bracket 85 may include one or more adjustable wall mount legs 86 attached to a mounting bracket 87. Preferably each adjustable mounting bracket 85 is telescoping, which makes the ladder securement device 80 adjustable for many different applications and sizes of gutters. A telescoping leg is utilized to adjust the length of the leg for attachment to the building. Each mounting bracket 87 may include fastening holes drilled therethrough to allow the installation, whether permanent or temporary, onto a building. An adjustable wall mount leg may be utilized as an adjustable feature, or may be of a single length if the dimension is known beforehand. The adjustable wall mount leg may include pins and screws for securement after adjusting, or any other known means for making an adjustable length of a leg. Ladder docking device 80 will therefore attach to the top of the building via ladder securement device 82 and will attach to the side of the building via each adjustable mounting bracket 85. This will allow a gutter to extend underneath the ladder locking device 80 without damaging the gutter.

Figure 5:
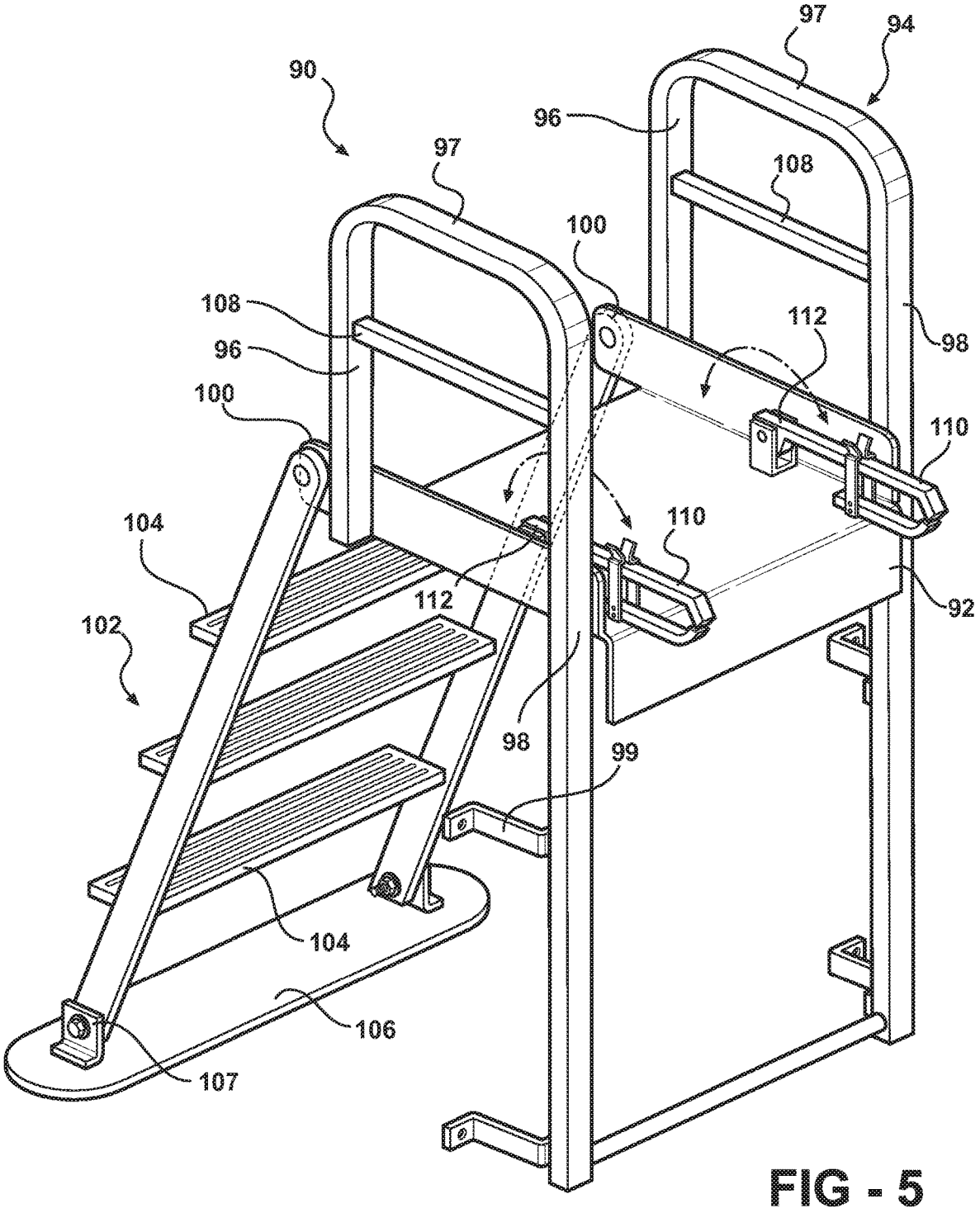
FIG. 5 illustrates a fifth embodiment of a ladder docking device with a pair of inverted "U" handrails.

FIG. 5 illustrates another embodiment of a flat roof ladder docking device, generally denoted by the numeral 90. The ladder docking device 90 includes a ladder securement device 92 as described above and a pair of handrail assemblies 94 are provided on opposite sides of ladder securement device 92. Each of the handrail assemblies 94 may be shaped in the form of an inverted "U" or an upwardly convex crook. Each handrail 94 has a supporting leg 96 at one end thereof and a guide rail 98 at the opposite end thereof. The guide rails 98 are several feet longer than the legs 96 of the handrails 94 and are connected and held parallel thereto by at least one transverse horizontally disposed connecting bar 97. In order to secure the handrail assemblies 94, the ladder docking device 90 may also include at least one wall mount 99 extending from the guide rail 98 to attach to a building. The ladder docking device 90 may optionally include a lifting device as disclosed in FIG. 3.

Referring again to FIG. 5, there is shown several additional aspects of the present invention including the optionally attached back ladder, or parapet ladder, generally denoted by the numeral 102. This ladder extends down from the top of the parapet to the flat roof, which is typically a distance of from about two (2) to (5) feet. The back ladder may find utility with any of the handrail embodiments disclosed in this case. This back ladder may be attached to the ladder securement device piece 92 by a parapet extension 100 of the end plates for the ladder securement device piece 92. In the extension piece 100, there may be a hole for receiving a pivot point attachment for back ladder 102. Back ladder 102 would include steps 104 angled for easy descent by the workers/maintenance crewmen. The bottom of the back ladder 102 could include a telescoping foot 106 to accommodate many different heights of roofs. Further, the foot could pivot via pivot attachments 107 to accommodate any roof pitch. In this embodiment, the ladder docking device would straddle the parapet, with the back ladder extending downwardly onto the flat roof of the building, and the rung catcher portion extending over the edge of the parapet.

Once again referring to FIG. 5, there may also be an additional safety feature of at least one ladder rung securement catcher lock 110. The present inventor envisions that catcher locks 110 would be in the "up position" after a ladder was removed, so that when another maintenance crewman would come up to the ladder securement device the next time, the rung catchers would be available. After the top rung of the ladder was hung on the rung catchers, the crewman would climb the ladder. Once he arrived at the top, he would push catcher locks 110 into position and they could pivot down via pivot points 112 and lock through any suitable means, such as tie downs, clips, or any other simple locking means. When the crewman was ready to descend down the ladder, he would unlock the catcher locks 110, descend the ladder, and use the top rung of his ladder to push up the catcher locks so that the next crewman to put a ladder up there would not be obstructed from hooking the top ladder rung onto the rung catchers.

FIG. 5 also shows additional optional safety horizontal rails 108 within the "U"-shaped ladder rails 90 so that a crewman would be less likely to fall through the opening of the rails 90, and fall off the roof. Although there are only two safety rails shown, any number of safety rails may be used to accommodate OSHA regulations, and/or the individual circumstances of the installation. Needless to say, the exact configuration of the ladder securement device may necessitate vertical, diagonal, or any other pattern of the safety rails 108.

In summary, numerous benefits have been described which result from employing any or all of the concepts and the features of the various specific embodiments of the present invention, or those that are within the scope of the invention. The ladder docking device may be permanently attached on the roof to increase ladder safety and reduce injuries and fatalities. The ladder docking device pitches and secures a ladder in an assigned location so that using the ladder while carrying tools and equipment up the ladder becomes safer and more secured. Ladder rung catchers of the ladder docking device capture the ladder rung to help avoid the ladder bottom from slipping on unstable or slippery surfaces, such as ice. Handrails provide a safe transition to the roof when stepping off the ladder or stepping down from the roof. Mounting brackets make the ladder docking device easy to be mounted to any building without roof penetration. Optionally, the docking device may include end plates to help avoid the ladder from sliding sideways off due to wind or slippage.

Moreover, the ladder docking device is environmentally friendly. For example, it prevents building finishes and ground parked vehicles from damage caused by a falling ladder. In addition, the ladder docking device does not require a ladder to be docked permanently, so it eliminates a vandal's attraction to permanently-mounted ladders and preserves its beauty and water tight integrity. With the ladder docking device, there would be no more dragging equipment or dirty filters through the inside of the building to use a roof hatch. The ladder docking device also keeps gutters from being banged up by using ladders.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims which are appended hereto.

INDUSTRIAL APPLICABILITY

The ladder docking device of the present invention contains industrial applicability because it increases ladder safety, thereby reducing injuries and fatalities. Specifically, the ladder docking device secures a ladder in an assigned location so that using the ladder and carrying tools and equipment up the ladder becomes safer and more secure. This ladder docking device captures one of the top ladder rungs to help avoid the ladder bottom from slipping on unstable or slippery surfaces, such as ice, and help avoid the ladder from sliding off sideways due to wind or slippage. The ladder docking device provides not only a safe transition to the roof when stepping off the ladder or stepping down from the roof, but also a sturdy mount to any building without roof penetration.

What is claimed is:

1. A ladder docking device permanently installed on a building for securing a ladder, the ladder having a ladder rung, comprising:

a roof faceplate and a wall faceplate being coupled together to form a right angle with respect to one another; the roof faceplate having a first width in a first direction from a first end to a second end thereof; the wall faceplate having a second width in the first direction from a first end to a second end thereof; the first width being equal to the second width, the roof faceplate and the wall faceplate including a mutual joint having the first width in the first direction;

a first end plate being coupled to the first end of the roof faceplate and the first end of the wall faceplate, the first end plate extending upwardly past a top surface of the roof faceplate;

a second end plate being coupled to the second end of the roof faceplate and the second end of the wall faceplate, the second end plate extending upwardly past the top surface of the roof faceplate, the first and second end plates preventing lateral movement of the ladder;

a first ladder rung hook being coupled to the top surface of the roof faceplate between the first and second end plates and extending away from the wall faceplate, the first ladder rung hook being positioned such that the ladder rung rests on a top surface of the first ladder rung hook;

a second ladder rung hook being coupled to the top surface of the roof faceplate between the first and second end plates and extending away from the wall faceplate, the second ladder rung hook being positioned such that the ladder rung rests on a top surface of the second ladder rung hook;

a first handrail coupled to the first end plate that extends above the first end plate and below the first end plate; and a second handrail coupled to the second end plate that extends above the second end plate and below the second end plate.

2. The ladder docketing device of claim 1, wherein:

the first and second ladder rung hooks being spaced apart from one another such that a first ladder rail of the ladder is disposed between the first ladder rung hook and the first end plate, and a second ladder rail of the ladder is disposed between the second ladder rung hook and the second end plate.

3. The ladder docketing device of claim 1, wherein:

the first ladder rung hook is a wide open ladder rung hook; and the first ladder rung hook directly contacting the ladder rung when the ladder rung rests on the first ladder rung hook.

4. The ladder docking device of claim 1, further comprising:

a first mounting bracket coupled to the first handrail and is disposed below the first end plate;

a second mounting bracket coupled to the second handrail and is disposed below the second end plate; and a crossbar being coupled to and between the first and second handrails and being disposed below the first and second endplates.

5. The ladder docking device of claim 1, wherein:

the first end plate extending upwardly past the top surface of the roof faceplate a greater distance than the first ladder rung hook extends upwardly past the top surface of the roof faceplate; and the second end plate extending upwardly past the top surface of the roof faceplate a greater distance than the second ladder rung hook extends upwardly past the top surface of the roof faceplate.

6. A ladder docking device permanently installed on a building for securing a ladder, the ladder having a ladder rung and first and second ladder rails, comprising:

a roof faceplate and a wall faceplate being coupled together to form a right angle with respect to one another; the roof faceplate having a first width in a first direction from a first end to a second end thereof; the wall faceplate having a second width in the first direction from a first end to a second end thereof; the first width being equal to the second width, the roof faceplate and the wall faceplate including a mutual joint having the first width in the first direction;

a first end plate being coupled to the first end of the roof faceplate and the first end of the wall faceplate, the first end plate extending upwardly past a top surface of the roof faceplate;

a second end plate being coupled to the second end of the roof faceplate and the second end of the wall faceplate, the second end plate extending upwardly past the top surface of the roof faceplate, the first and second end plates preventing lateral movement of the ladder;

a first ladder rung hook being coupled to the top surface of the roof faceplate between the first and second end plates and extending away from the wall faceplate, the first ladder rung hook being positioned such that the ladder rung rests on a top surface of the first ladder rung hook;

a second ladder rung hook being coupled to the top surface of the roof faceplate between the first and second end plates and extending away from the wall faceplate, the second ladder rung hook being positioned such that the ladder rung rests on a top surface of the second ladder rung hook; and the first and second ladder rung hooks being spaced apart from one another such that the first ladder rail of the ladder is disposed between the first ladder rung hook and the first end plate, and the second ladder rail of the ladder is disposed between the second ladder rung hook and the second end plate.

7. The ladder docking device of claim 6, wherein:

the first end plate extending upwardly past the top surface of the roof faceplate a greater distance than the first ladder rung hook extends upwardly past the top surface of the roof faceplate; and the second end plate extending upwardly past the top surface of the roof faceplate a greater distance than the second ladder rung hook extends upwardly past the top surface of the roof faceplate.

8. A ladder docking device permanently installed on a building for securing a ladder, the ladder having a ladder rung, comprising:

a roof faceplate and a wall faceplate being coupled together, the roof faceplate being adapted to be coupled to a roof of the building, the wall faceplate being disposed against a vertical wall of the building;

a first end plate being coupled to a first end of the roof faceplate and a first end of the wall faceplate, the first end plate extending upwardly past a top surface of the roof faceplate;

a second end plate being coupled to a second end of the roof faceplate and a second end of the wall faceplate, the second end plate extending upwardly past the top surface of the roof faceplate, the first and second end plates preventing lateral movement of the ladder;

a first ladder rung hook being coupled to the top surface of the roof faceplate between the first and second end plates and extending away from the wall faceplate, the first ladder rung hook being positioned such that the ladder rung rests on a top surface of the first ladder rung hook;

the first end plate extending upwardly past the top surface of the roof faceplate a greater distance than the first ladder rung hook extends upwardly past the top surface of the roof faceplate; and the second end plate extending upwardly past the top surface of the roof faceplate a greater distance than the first ladder rung hook extends upwardly past the top surface of the roof faceplate.

9. The ladder docking device of claim 8, wherein:

the roof faceplate and the wall faceplate being coupled together to form a right angle with respect to one another.

10. The ladder docking device of claim 8, wherein:

the roof faceplate having a first width in a first direction from the first end to the second end thereof; the wall faceplate having a second width in the first direction from the first end to the second end thereof; the first width being equal to the second width, the roof faceplate and the wall faceplate including a mutual joint having the first width in the first direction.

11. The ladder docking device of claim 8, wherein:

a second ladder rung hook being coupled to the top surface of the roof faceplate between the first and second end plates and extending away from the wall faceplate, the second ladder rung hook being positioned such that the ladder rung rests on a top surface of the second ladder rung hook; and the first and second ladder rung hooks being spaced apart from one another such that a first ladder rail of the ladder is disposed between the first ladder rung hook and the first end plate, and a second ladder rail of the ladder is disposed between the second ladder rung hook and the second end plate.

* * * * *